United States Patent [19]

Rudenauer

[11] Patent Number: 4,873,927

[45] Date of Patent: Oct. 17, 1989

[54] PYROTECHNIC FUZE FOR PROJECTILES, ROCKETS, BOMBLETS AND MINES

[75] Inventor: Werner Rudenauer, Roth, Fed. Rep. of Germany

[73] Assignee: DIEHL GmbH & Co., Nuremberg, Fed. Rep. of Germany

[21] Appl. No.: 277,272

[22] Filed: Nov. 29, 1988

[30] Foreign Application Priority Data

Dec. 3, 1987 [DE] Fed. Rep. of Germany ..... 3740966

[51] Int. Cl.[4] ..... F42B 13/50; F42C 15/04; F42C 15/22

[52] U.S. Cl. ..... 102/269; 102/226

[58] Field of Search ..... 102/266, 269, 256, 226, 102/229, 230, 235, 244, 246

[56] References Cited

U.S. PATENT DOCUMENTS

| | | | |
|---|---|---|---|
| 2,838,999 | 6/1958 | Corsi | 102/269 |
| 3,119,336 | 1/1964 | Hjelm | 102/269 |
| 3,630,152 | 12/1971 | Arnell | 102/256 |
| 3,998,164 | 12/1976 | Hadfield | 102/226 |
| 4,653,401 | 3/1987 | Gatti | 102/226 |
| 4,762,066 | 8/1988 | Rudenauer et al. | 102/269 |

FOREIGN PATENT DOCUMENTS 3524080 8/1987 Fed. Rep. of Germany .

*Primary Examiner*—David H. Brown

*Attorney, Agent, or Firm*—Scully, Scott, Murphy & Presser

[57] ABSTRACT

A pyrotechnic fuze for projectiles, rockets, bomblets and mines, which possesses a triggering device for a delay detonator in a transversely movable slider housing, and a detonator for the triggering of an explosive charge, whereby the delay detonator is arranged to extend transversely relative to the detonator.

3 Claims, 1 Drawing Sheet

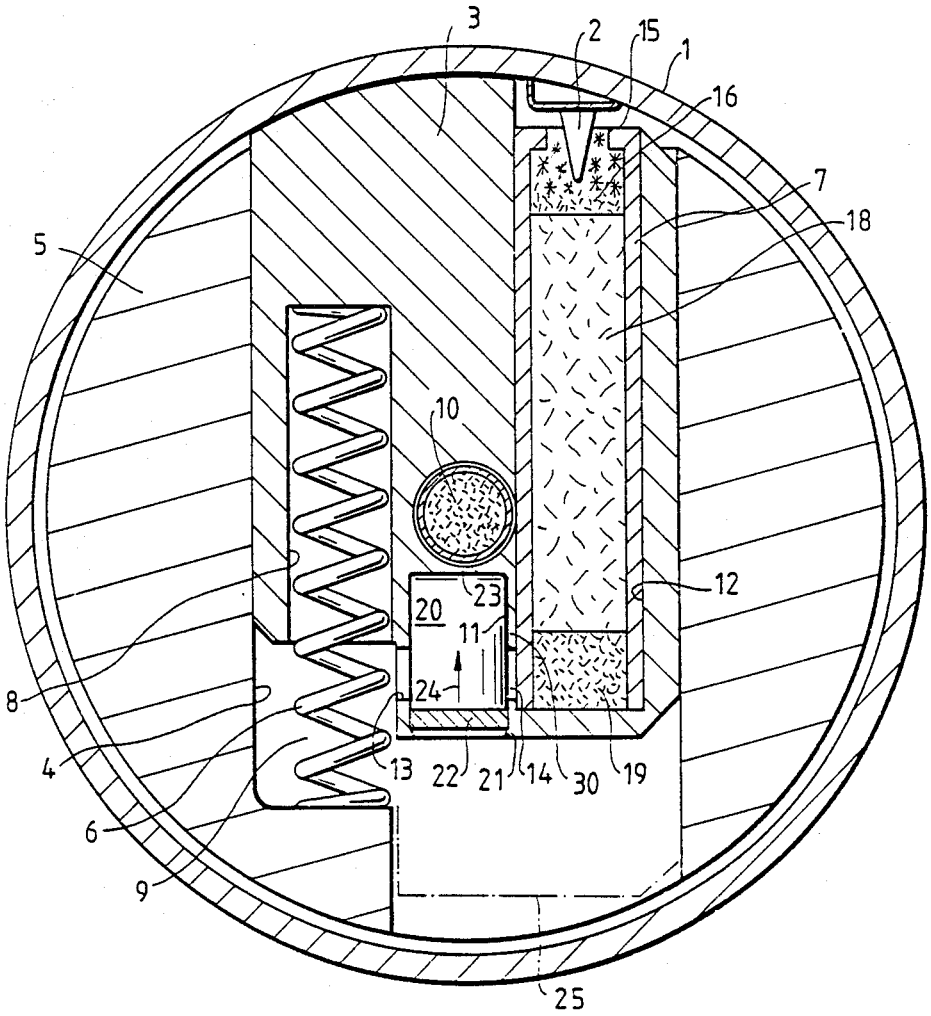
3
2
15
1
16
7
18
5
10
12
23
20
11
24
8
4
13
22
21
14
30
19
6
9
25

PYROTECHNIC FUZE FOR PROJECTILES, ROCKETS, BOMBLETS AND MINES

BACKGROUND OF THE INVENTION

1. Field of the Invention

The present inveniton relates to a pyrotechnic fuze for projectiles, rockets, bomblets and mines, which possesses a triggering device for a delay detonator in a transversely movable slider housing, and a detonator for the triggering of an explosive charge, whereby the delay detonator is arranged to extend transversely relative to the detonator.

2. Discussion of the Prior Art

In a fuze for bomblets pursuant to the disclosure of German Patent No. 35 24 080 A1, in a transversely movable slider there is provided a detonator and a triggering charge for a delay composition which is fixed arranged within a housing. Due to the spatial separation between the triggering charge and the delay composition, this can lead to malfunctions in the triggering transmission, such that the detonator will not be activated. At a soft impact against a target this has the consequence, that the functions of the usually present impact detonator, which have not come into action, cause the detonator to remain armed and thereby the bomblet is turned into a dud.

SUMMARY OF THE INVENTION

Accordingly, it is an object of the invention to be able to achieve an assured triggering of the delay composition.

The foregoing object is achieved through the intermediary of a pyrotechnic fuze of the type which is considered herein, in that a relaying or transmission detonator is arranged in the slider intermediate the detonator and the transfer triggering composition for the delay detonator.

Through the invention there is advantageously achieved, that with a relatively small constructional volume, there is afforded the assured triggering of the detonator for a projectile as well as for a bomblet either with or without any spin.

BRIEF DESCRIPTION OF THE DRAWINGS

Reference may now be had to the following detailed description of an exemplary embodiment of the invention, taken in conjunction with the accompanying single FIGURE of drawing, illustrating a transverse sectional view through a pyrotechnic fuze.

DETAILED DESCRIPTION

In a housing 1 for a bomblet possessing a firing pin 2 or primer, a slider 3 is latched in the firing position in a manner known in the technology. The slider 3 is located in a guideway 4 provided in a member 5. The slider 3 possesses a spring 6, a gas expansion space 9 intermediate the slider 3 and the member 5, and in which there is located the spring 6, a detonator 10 for the triggering of a generally known and usual explosive charge (not shown), three parallel bores 8, 11, 12 and passageway sections 13, 14.

The bore 12 is located transversely of; in essence, tangential to the detonator 10, and possesses a delay detonator 15, consisting of a triggering composition 16, a delay composition 18 and a transfer composition 19 all within a narrow tube 7. The triggering composition 16, as illustrated, is already in reaction.

Fastened within the bore 11 is a transmission detonator 20 through the interposition of a disc 22 which is wedged in at 21. A wall 23 separated the transmission detonator 20 from the detonator 10.

A phantom-line 25 identifies the specially secured initial position of the slider 3.

The function of the fuze for a bomblet which rotates at a high rotational speed is generally as follows:

The slider 3 which has been unlatched in a known manner, because of the force of the spring 6 and in response to the centrifugal forces strikes against the housing 1, and is latched by means of a machanism which is known per se in the illustrated position such a latching and unlatching mechanism is known from the disclosure of Rudenauer U.S. Pat. No. 4,762,066, assigned to the common assignee of this application, and the disclosure of which is incorporated herein by reference. Upon impact, the triggering composition 16 is activated by the firing pin 2. Commencing from the triggering composition 16, there is then effected the ignition of the remaining composition 18 and 19 and the triggering of the transmission detonator 20. The latter will then initiate the detonator 10 through the wall 23. The assured triggering of the detonator 10 is also provided under the most adverse conditions. As a consequence thereof, there are avoided any duds.

The foregoing is also aided by the passageway section 13 communicating with the gas expansion space 9, which will conduct off the excess pressure generated upon the triggering of the transmission detonator 20 into the interior of the housing 1. As a result thereof, the detonator 10 remains fully capable of functioning in its vertical triggering action. The transfer composition 19 destroys thin structures and is thereby in a position to securely trigger the transmission detonator 20 through the thin wall 30. Consequently, the existence of the bore 14 is not an absolute prerequisite.

When no spin is present in the bomblet or, respectively, at the fuze, then the arming of the slider 13 is to be carried out by the spring 6 alone.

What is claimed is:

1. A pyrotechnic fuze for projectiles, rockets, bomblets and mines, including a transversely movable housing of a slider; triggering means for a delay detonator and an explosive charge triggering detonator in said housing, said delay detonator being arranged transversely of the detonator; and a transmission detonator being arranged in the slider in parallel with the delay detonator intermediate the explosive charge triggering detonator and a transfer composition for the delay detonator for the triggering of an explosive charge, said slider including a passageway section at the transfer detonator communicating with a gas expansion space intermediate said slider and a guideway for said slider.

2. A pyrotechnic fuze as claimed in claim 1, wherein the slider has three mutually parallel bores formed therein for, respectively, a spring, the delay detonator and the transmission detonator.

3. A pyrotechnic fuze as claimed in claim 2, wherein a passageway section for the ignition of the transmission detonator is located between two of said bores in the region of the transmission detonator.

* * * * *